US005893639A

United States Patent [19]

Tetoldini

[11] Patent Number: 5,893,639

[45] Date of Patent: Apr. 13, 1999

[54] APPARATUS FOR PRODUCING AND SIMULATANEOUSLY DISTRIBUTING CEMENT MIXES AND THE LIKE

[75] Inventor: Fabrizio Tetoldini, Paderno Franciacorta, Italy

[73] Assignee: Blend S.r.l., Reggiolo, Italy

[21] Appl. No.: 08/879,373

[22] Filed: Jun. 20, 1997

[30] Foreign Application Priority Data

Jun. 26, 1996 [IT] Italy ..... MI96A1303

[51] Int. Cl.[6] ..... B28C 7/06

[52] U.S. Cl. ..... 366/18; 366/19; 366/21; 366/27; 366/32; 366/50

[58] Field of Search ..... 366/16, 18, 21, 366/27, 28, 30, 33, 34, 35, 37, 38, 40, 50, 64, 68, 114, 134, 141, 153.3, 19, 154.1, 186, 32, 194–196

[56] References Cited

U.S. PATENT DOCUMENTS

| | | | |
|---|---|---|---|
| 964,512 | 7/1910 | Handle | 366/21 |
| 1,834,670 | 12/1931 | Yett | 366/21 X |
| 2,945,684 | 7/1960 | Soldini | 366/606 X |
| 3,667,736 | 6/1972 | Caroll . | |
| 4,219,279 | 8/1980 | Haws | 366/37 X |
| 4,406,548 | 9/1983 | Haws | 366/37 X |
| 4,427,297 | 1/1984 | Stastny . | |
| 4,551,024 | 11/1985 | Clapp . | |
| 4,624,575 | 11/1986 | Lantz | 366/34 X |
| 4,792,234 | 12/1988 | Doherty | 366/18 X |
| 4,907,890 | 3/1990 | Lepper . | |
| 4,922,463 | 5/1990 | Del Zotto et al. | 366/37 X |
| 5,044,819 | 9/1991 | Kilheffer et al. | 366/18 X |
| 5,433,520 | 7/1995 | Adams et al. | 366/35 X |
| 5,624,183 | 4/1997 | Schuff | 366/35 X |
| 5,667,298 | 9/1997 | Musil et al. | 366/18 |

FOREIGN PATENT DOCUMENTS

| | | |
|---|---|---|
| 0 323 131 | 7/1989 | European Pat. Off. . |
| 4244282 | 7/1994 | Germany . |
| 1 107 952 | 3/1968 | United Kingdom . |
| 1 165 551 | 10/1969 | United Kingdom . |

*Primary Examiner*—Charles E. Cooley
*Attorney, Agent, or Firm*—Guido Modiano; Albert Josif

[57] ABSTRACT

Apparatus for distributing and producing cement mixes, substantially concrete, using an endless conveyor belt movable at the base of separate containers which contain the inert materials and the cement, and a reservoir for the mixing water, to form proportioned mixes in a screw mixer, with unloading of the product simultaneously with mixing; the apparatus comprising a supporting framework, on which are supported, at least one hopper-like prism-shaped container for the inert materials with adjustable discharge openings, and, in a raised position with respect to the hopper for the inert materials, at least one hopper-shaped container with adjustable opening for the cement; an endless conveyor belt being interposed between the framework and the discharge openings of the hoppers for the inert materials and for the cement, which are aligned to each other along an inclined plane; the belt is arranged at an angle along the plane of arrangement of the discharge openings, so as to make contact with, and pass beyond, the cement discharge opening; a screw mixer is associated with the hopper that contains the cement, is arranged so as to have a horizontal axis, and is moved by a suitable drive. The conveyor belt conveys into the screw proportioned amounts of inert materials and cement and then allow their mixing with likewise proportioned amounts of water drawn from the reservoir, simultaneously with the unloading of the concrete from the screw.

8 Claims, 5 Drawing Sheets

APPARATUS FOR PRODUCING AND SIMULATANEOUSLY DISTRIBUTING CEMENT MIXES AND THE LIKE

BACKGROUND OF THE INVENTION

The present invention relates to a fixed or self-propelled apparatus for distributing and producing cement mixes, substantially concrete, directly at the time of use in building yards and the like.

Conventional cement mixes, and particularly concrete for casting into formworks or the like, are usually constituted by proportioned mixes of inert materials, such as sand, gravel and others, with cement of various kinds and with water: the dosage of the components and of the water is chosen according to the structural characteristics which the concrete is to have and according to the type of use thereof.

Cement mixes are currently usually produced in fixed plants which are specifically equipped, and the resulting product is then transferred to building yards or the like by means of well-known truck mixers, i.e., trucks provided with an inclined and continuously rotatable container inside which the mixture of the components is kept under agitation to prevent changes in the characteristics and properties of the concrete during transport. It is also known that in order to allow the concrete to preserve its strength as much as possible during transport, the fixed mixing plant must be equipped with a forced premixing device.

Accordingly, truck mixers can be loaded only from a specific plant and after filling it is impossible to proportion the cement and the water.

The degree of preservation during transport by means of truck mixers is acceptable only for trips limited to a few kilometers and with the aid of suitable additives; moreover, the transport of the ready-mixed concrete in truck mixers also entails the drawback that considerable time and a very high consumption of energy and water are required for the loading, transport, unloading and washing operations.

In order to obviate the drawbacks entailed by the use of truck mixers to transport the ready-mixed concrete, mixing equipment or plants have already been proposed which are structured so as to simultaneously perform at the building yard the mixing of the materials that constitute the concrete and the subsequent unloading into the formworks; in this manner, the well-known deteriorations of ready-mixed concrete caused by transport are avoided and significant advantages are allowed in practice as regards precision in the dosage and mixing of the components, graduality of unloading, and therefore better uniformity and greater strength of the resulting product.

However, even this method has some drawbacks, especially as regards the energy consumption required by the mixing apparatus. This arises from the fact that the inert products and the cement are made to advance horizontally by means of a conveyor belt which receives the proportioned amounts from overlying containers and are then sent into a screw mixer, into which the mixing water is also sent; said mixer is arranged with a vertical or optionally inclined axis in order to allow the mixed product to rise and exit upwards and then enter the formworks by means of chutes. The vertical arrangement of the mixing screw therefore requires the use of high power to make the product rise along said screw up to the upper exit end; the screw mixer is also usually provided with an inclination which can vary both longitudinally and transversely with respect to the containers of the components, and this entails in practice a considerable bulk.

SUMMARY OF THE INVENTION

Accordingly, the aim of the present invention is to provide an apparatus for manufacturing cement mixes and the like, which is conceived so as to obviate the drawbacks of current fixed plants for ready-mixing the components of the concrete and of the corresponding truck mixers for transporting said concrete, and is most of all capable of producing mixes with precise dosage directly and simultaneously with the unloading into the formworks, and therefore with the advantage of having a considerably reduced energy consumption with respect to currently used loading, transport, unloading and washing systems.

Another object of the invention is to provide an apparatus for distributing and producing cement mixes which is structured so as to allow to maintain high strength and preservation characteristics for the components during transport and in any weather condition.

Another object is to allow to proportion the components and the water both manually and automatically or semiautomatically.

Another object of the invention is to provide an apparatus of the above-specified type which is structured so as to allow to divide the containers, or at least the container for the inert materials, into compartments in order to allow the differentiated proportioning of the products and is also such that it can be used both as a fixed plant and as a transportable plant on self-propelled vehicles, trailers and the like.

This aim, these objects and others which will become apparent from the following description are achieved by an apparatus for distributing and producing cement mixes, substantially concrete, of the type that uses an endless conveyor belt which can move at the base of separate containers which contain the inert materials and the cement, and a reservoir for the mixing water, so as to allow to form proportioned mixes in a screw mixer, with unloading of the product simultaneously with mixing, said apparatus being constituted, according to the present invention, by a supporting framework, a reservoir for the mixing water, at least one hopper-like prism-shaped container for the inert materials with adjustable discharge openings, and, in a raised position with respect to said hopper for the inert materials, at least one hopper-shaped container with adjustable opening for the cement being anchored to said supporting framework; an endless conveyor belt being interposed between said framework and the discharge openings of said hoppers for the inert materials and for the cement, which are aligned to each other along an inclined plane, said belt being arranged at an angle along the plane of arrangement of said discharge openings, in order to make contact with, and pass beyond, the discharge opening provided on the bottom of said hopper that contains the cement; a screw mixer being associated with said hopper that contains the cement, being arranged so as to have a horizontal axis and being moved by a suitable drive, so as to allow said conveyor belt to convey into said screw proportioned amounts of inert materials and cement and then allow their mixing with proportioned amounts of water drawn from said reservoir, simultaneously with the step for the unloading of the concrete from said screw.

More particularly, said conveyor belt is arranged, along most of its length, in contact with, and inside, the inclined bottom wall of the hopper that contains the inert materials, so that the opening of said hopper is formed by a cutoff lamina which is arranged so as to be parallel to the belt and at a given distance from the transverse wall of the hopper and so as to leave an end portion of the belt directly in contact with the inert materials, said cutoff lamina being arranged so that its elevation is adjustable, with respect to the underlying belt, to allow operations for feeding inert materials which are proportioned according to requirements.

The end portion of the belt, which passes beyond the hopper for the inert materials, is instead located below an opening formed in the bottom of the container for the cement, and its discharge port is adjusted by a choke lamina which can move externally and parallel to the bottom of the container by means of a double-action actuation piston which is rigidly coupled to said bottom.

Moreover, an additional choke lamina for the inert materials before their mixing with the cement is located in the inclined transverse part that divides the two hoppers; its elevation is adjustable with respect to the underlying belt both manually and by means of mechanical, electrical or similar controls.

Likewise, vibrating devices which are suitable to facilitate the descent of the materials onto the conveyor belt are associated with the walls of the hoppers for the inert materials and for the cement, whilst conventional continuous weighing cells for the inert materials and for the cement are associated with said belt.

BRIEF DESCRIPTION OF THE DRAWINGS

Further characteristics and advantages of the present invention will become apparent from the following detailed description, given with reference to the accompanying drawings, which are provided only by way of non-limitative example and wherein.

DESCRIPTION OF THE PREFERRED EMBODIMENTS

Figure 1:
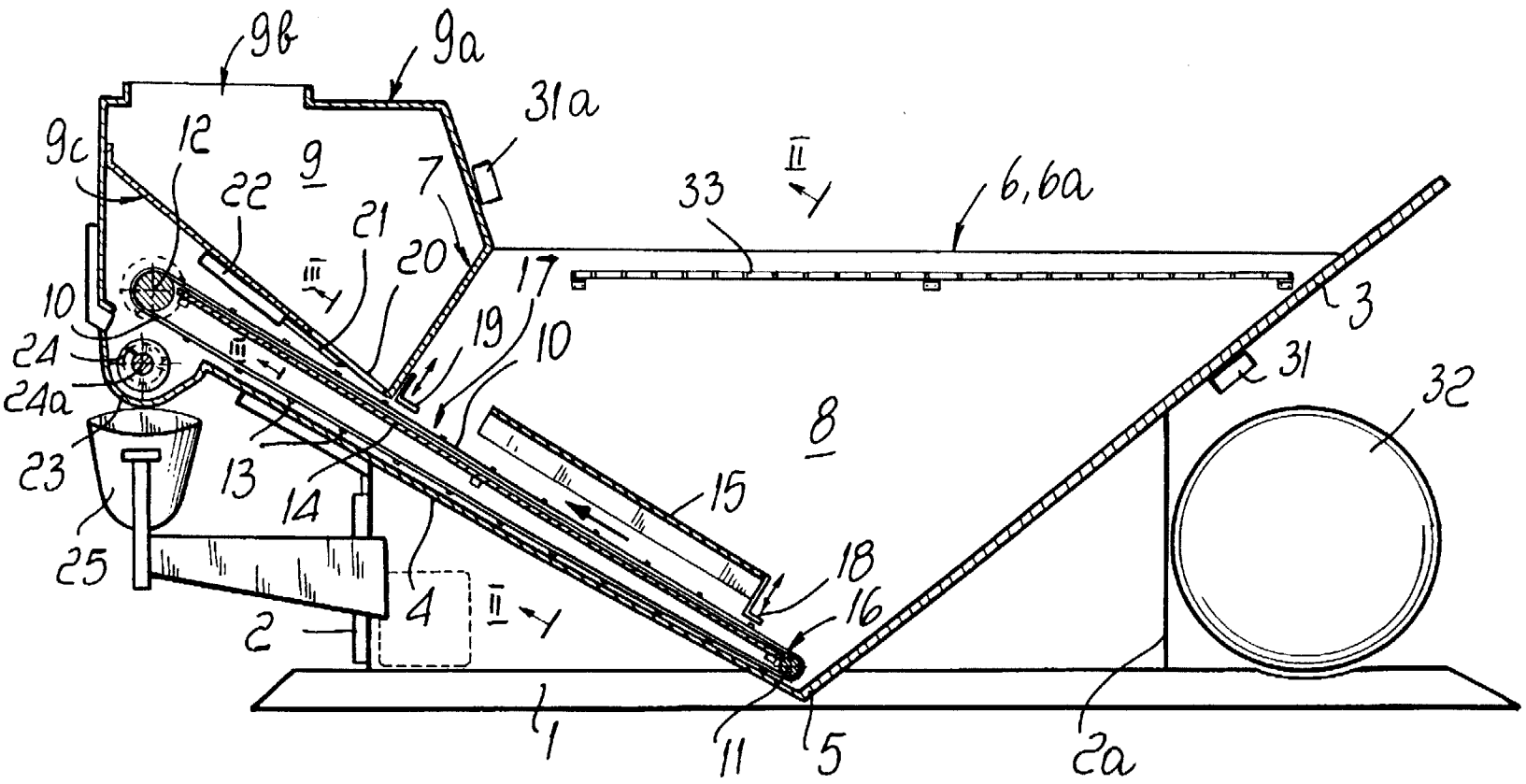
FIG. 1 is a partially sectional schematic side view of an apparatus for producing, mixing and simultaneously unloading cement mixes, executed according to the present invention.

With reference to the above figures, and in particular to FIGS. 1 to 4, the apparatus according to the invention is substantially constituted by a quadrangular framework 1 which constitutes a flat supporting base on which a container body is anchored by means of uprights 2–2*a* which rise from said framework. The body is substantially shaped like an inverted wedge, i.e., it is constituted by two substantially rectangular flat walls 3 and 4, which diverge with respect to each other so that the vertex 5 (FIG. 1) is in contact with the supporting framework, and by two side walls 6–6*a* (FIG. 2) which are substantially triangular and diverge so as to give the container the shape of a hopper which is substantially shaped like a truncated pyramid.

Said inverted-wedge container is also divided, by means of an intermediate wall 7, into two containers (FIG. 1), one of which, designated by the reference numeral 8, is meant to contain the inert materials (sand, gravel or the like), whilst the other one, in a raised position and designated by the reference numeral 9, is meant to contain the cement. The container 8 for the inert materials is of the open-top type, whilst the container 9 for the cement is provided with a closure wall 9*a* with an opening 9*b* for introducing the material and with an inclined wall 9*c* (FIG. 1) which constitutes the chute-shaped bottom of said container 9. The bottom is therefore separated from the underlying continuous wall 4. In the space between the inclined wall 4 (FIG. 1) and the bottom wall 9*c* of the cement container 9 there is an endless conveyor belt 10, which is stretched between a free roller 11 and a motorized roller 12 and whose length is such as to correspond to the distance between the corner region 5 and practically all of the extension of the bottom wall 9*c* of the cement container 9, as will become apparent hereinafter.

Figure 2:
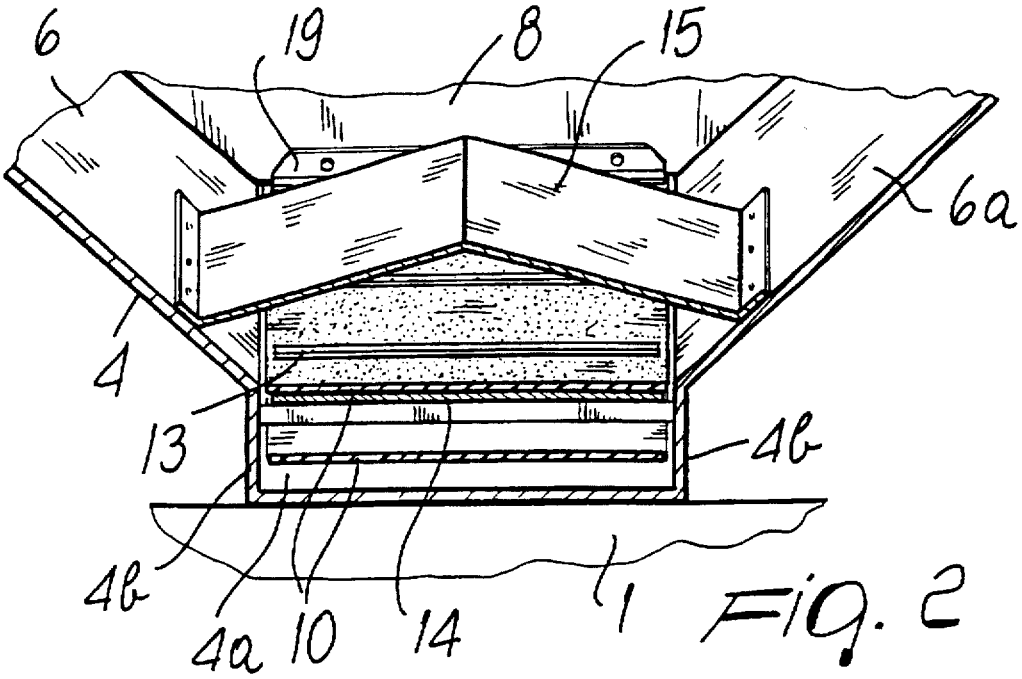
FIG. 2 is an enlarged-scale transverse sectional view of FIG. 1, taken along the plane II—II of said figure.
Figure 3:
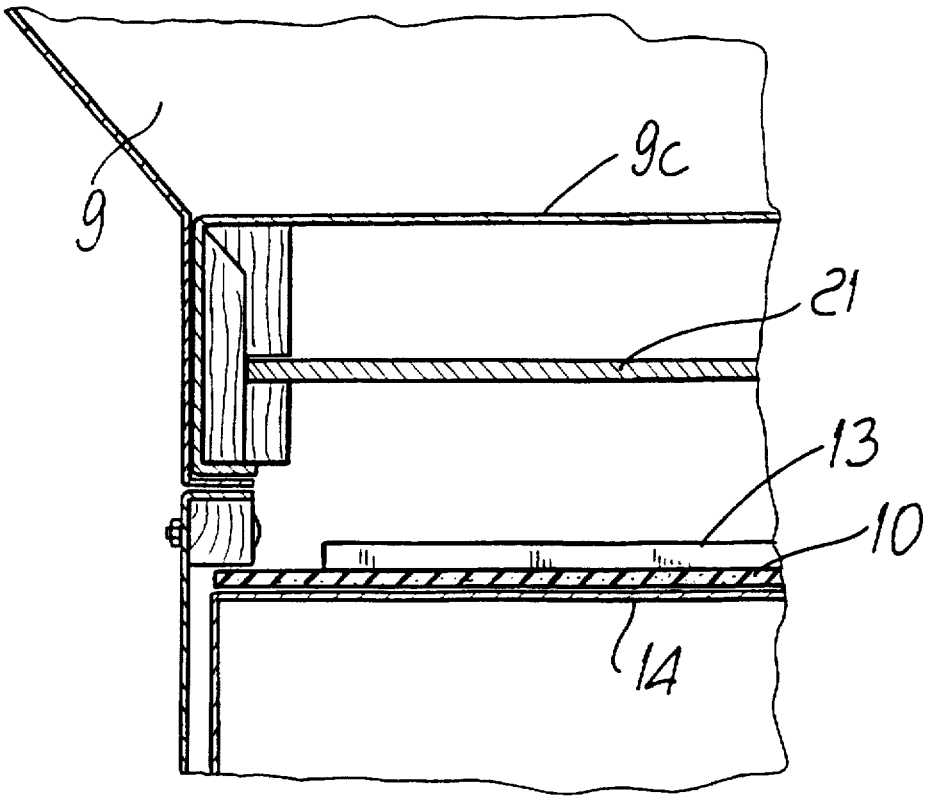
FIG. 3 is also a transverse sectional view of said FIG. 1, taken along the plane III—III.
Figure 4:
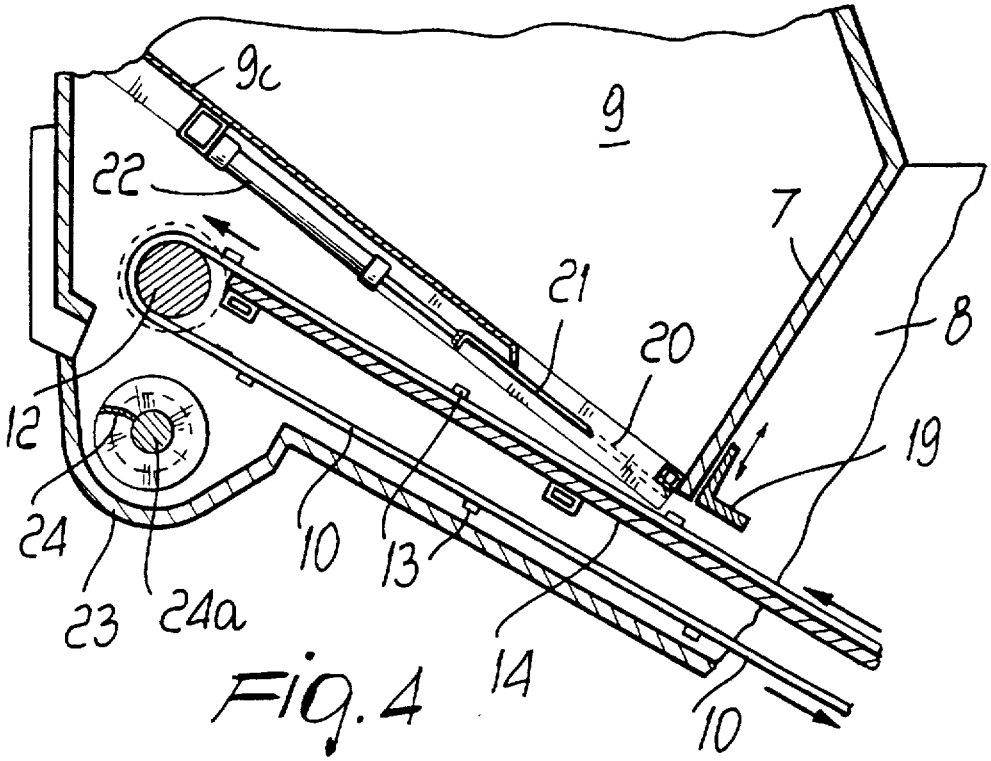
FIG. 4 is an enlarged-scale sectional view, showing only the assembly constituted by the cement hopper and the underlying mixing screw, shown in FIG. 1.

As clearly shown in FIG. 2, said conveyor belt 10 has such a width that it can be accommodated in a quadrangular recess 4*a* formed along the entire length of the wall 4 (and not shown in FIG. 1), so that the moving belt is constantly in contact with the inert materials contained in the hopper 8.

In order to prevent the inert materials from entering the recess 4*a*, at the top of the sides of the vertical walls 4*b* of said recess it is possible to anchor flexible laminae (not shown) which are placed in sliding contact with the belt of the conveyor (FIG. 2).

Moreover, the belt 10 of the conveyor is provided, as in conventional conveyors, with equidistant transverse strips 13 for moving the material upwards, and is installed so that it can slide on a fixed plane 14 to prevent the flexing of said belt under the weight of the material during transport. Likewise, in order to prevent the considerable weight of the inert material contained in the hopper 8 from bearing on the entire length of the underlying conveyor belt, a wedge-shaped cover 15 is anchored to the opposite walls 6–6*a* (FIGS. 1 and 2), is arranged transversely to the belt, and is shorter than the portion of conveyor belt which is included in the hopper 8, so as to leave only two belt portions in contact with the material: an exposed portion 16 at the lower end of the conveyor and an exposed portion 17 at the other end (FIG. 1). Moreover, a cutoff or choke lamina 18 (FIG. 1) is anchored to the lower end of the transverse cover 15 so that it can move at right angles to the conveyor, is arranged parallel to the belt of said conveyor, and is suitable to form a gap of adjustable width between the lamina 18 and the belt 10.

Said adjustable gap allows to proportion the amount of inert materials fed by the initial portion 16 of the belt; moreover, again in order to allow adjustable proportioning of the inert materials, at the base of the dividing wall 7 there is a similar choke lamina 19 which is parallel to the conveyor and can move vertically to it.

In order to allow proportioning of the cement contained in the hopper 9, in the bottom wall 9*c* of said hopper there is a quadrangular opening 20, whose size can be changed by means of a choke lamina 21 (FIGS. 1 and 4) which can slide in contact with said bottom wall and is actuated by a double-action actuation piston 22.

The inert materials and the cement can be proportioned by shifting the choke laminae with manual or mechanical systems or even automatically or semiautomatically. The lamina 21 provided on the bottom of the cement hopper can be pushed into contact against the wall 7 and can thus hermetically close the discharge opening 20; this can be useful during the transport of the apparatus, when the belt is not moving.

The inclined wall 4, with which the conveyor belt is associated, is provided, at its end connected to the outside wall of the cement hopper 9, with a substantially semi cylindrical flared portion 23 (FIGS. 1-4-6) which is arranged transversely to the belt 10 and in which a vane screw 24 is rotatably installed to mix the inert materials and the cement which are fed by gravity from the end of the conveyor.

Figure 5:
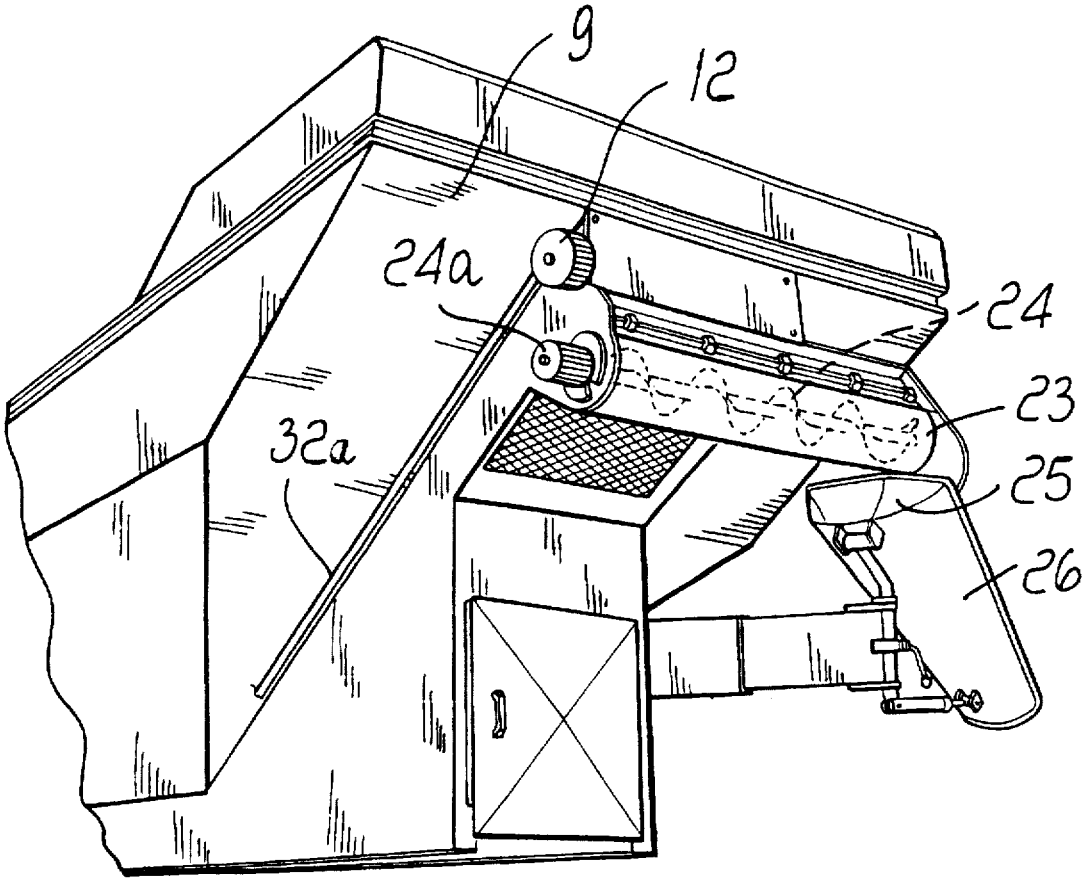
FIG. 5 is an enlarged-scale front view, showing in axonometric projection only the front part of the cement hoppers-mixing screw assembly.

A mix collecting body 25 is also associated with said mixing screw at its outlet end, and a chute 26 (FIG. 5) is associated with said body and can be orientated both vertically and horizontally to introduce the concrete mix into the formworks simultaneously with the production of said mix.

In order to move the conveyor 10, there is an independent drive which is keyed on the traction roller 12, whilst for the rotation of the screw 24 there is a separate drive which is keyed on the shaft 24*a* of said screw.

Finally, the apparatus is provided with a mixing water reservoir 32, from which said water can be sent, in a proportioned amount, into the screw (FIG. 5) by means of tubes 32*a* and a corresponding pump (not shown).

However, in practice and according to requirements, both the conveyor 10 and the screw 24 can be moved by means of a single motor which has, for example, a pulley which is associated with the motor of the conveyor and can actuate, by means of a chain or toothed belt, another pulley which is associated with the shaft of the screw.

Figure 8:
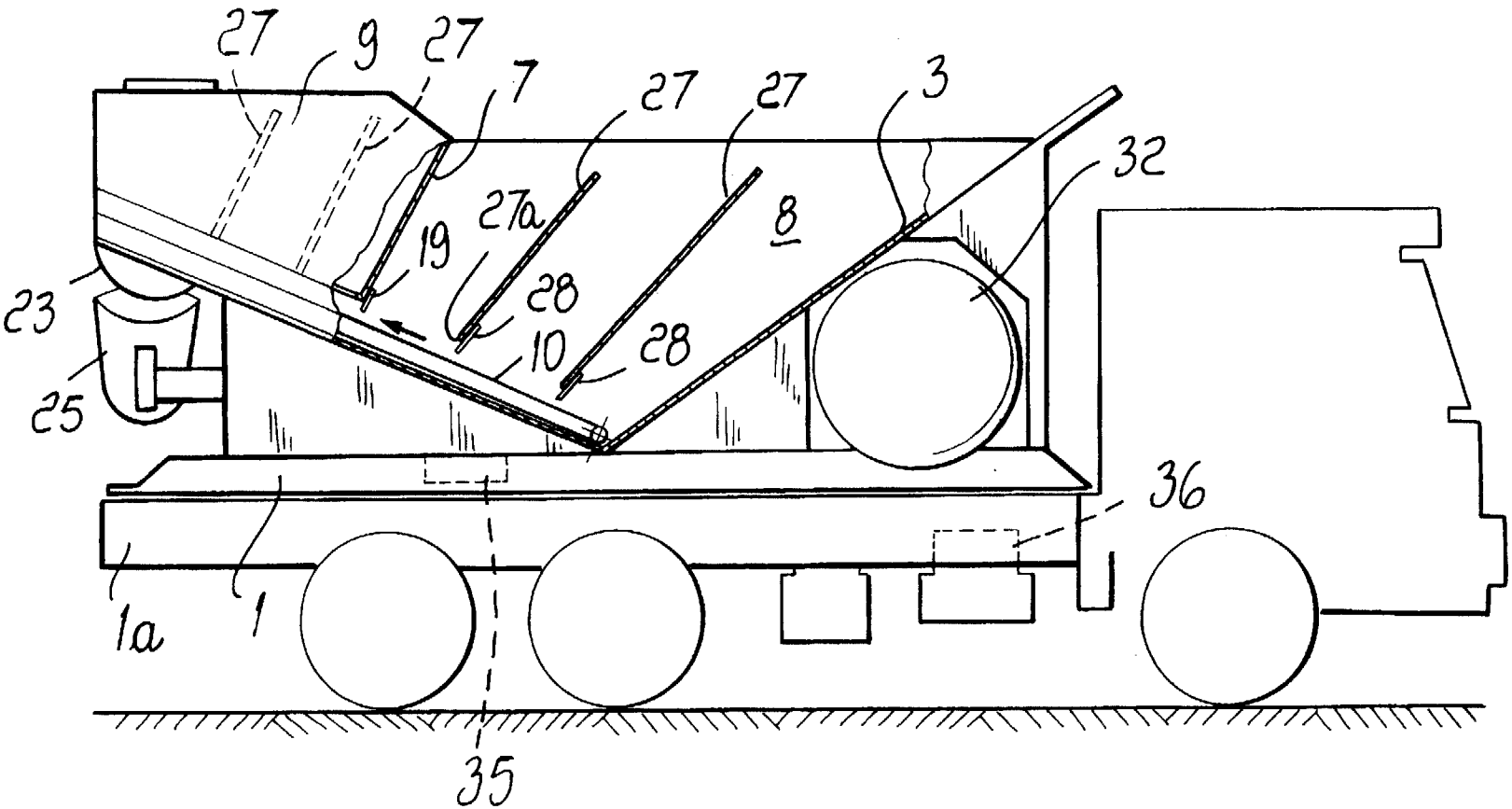
FIG. 8 is a schematic side view of a flatbed truck on which the apparatus of FIG. 1 is installed.

Moreover, in the case of an apparatus installed on the bed 1*a* of a truck, as shown schematically in FIG. 8, the power take-off for moving the conveyor and the screw can be taken either from the gearbox 36 of the truck engine or from the device 35 for tilting the bed of a tilt-bed truck.

The apparatus described above can also have partitions 27 (FIG. 8) provided in the hoppers for the inert materials and for the cement, for the differentiated proportioning of different materials: in said partitions, the horizontal side can also be arranged at a short distance from the ribbon, so as to form an opening whose size can be adjusted by means of laminae 28 which can slide in contact with said partitions; said laminae, in addition to allowing independent proportionings of the various inert materials (or cement), allow to hermetically close the various compartments during the transport of the apparatus.

Figure 6:
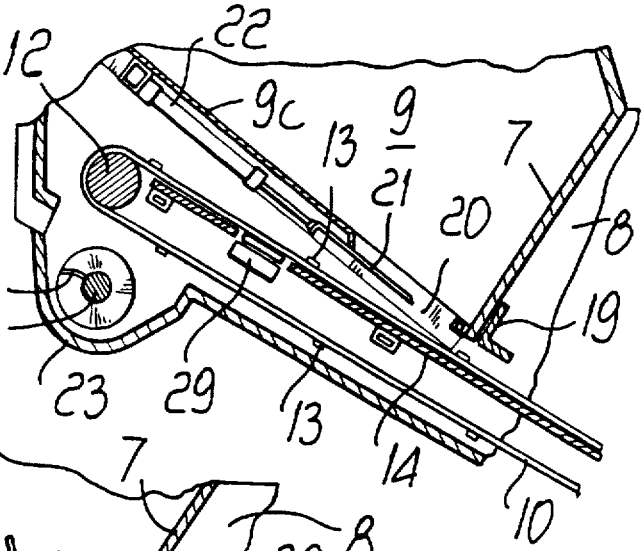
FIGS. 6 and 7 are sectional views of two different embodiments of the cement hopper and of the corresponding screw; whilst

Also according to the invention, one or more load cells 29 can be associated with the conveyor 10 for the continuous electronic weighing of the load supported by the conveyor, as shown in FIG. 6. Likewise, vibrating devices 31–31*a* et cetera (FIG. 1), suitable to facilitate the descent of the material, can be applied to the walls of the hoppers 8 and 9.

Figure 7:
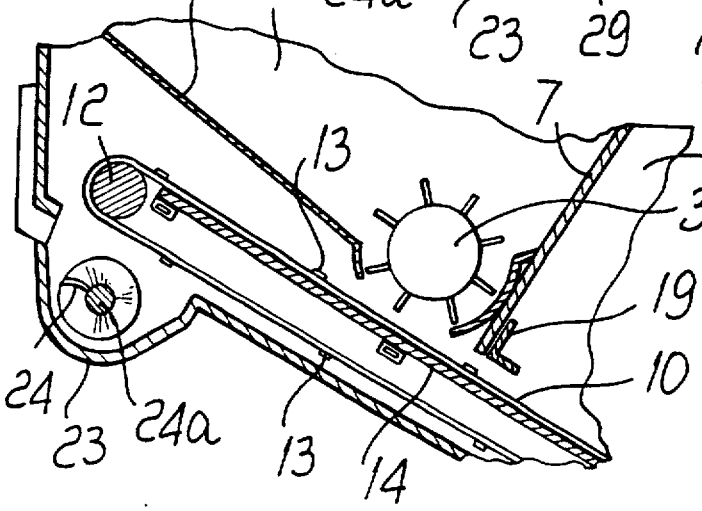

Moreover, the choke lamina 21 of the discharge port 20 of the cement hopper can be replaced with a volumetric dosage device 30 of the star type (FIG. 7) in which the rotation rate can be adjusted according to requirements.

Finally, the hopper for the inert materials can be provided, in an upward region, with a protective net 33 (FIG. 1).

From the above description, in practice, it has been possible to note that the apparatus according to the invention allows to obtain a plurality of practical and economic advantages with respect to conventional truck mixers, which can be summarized as follows:

- various kinds of concrete obtained with the above-described apparatus at the time of unloading, with forced mixing and precise proportioning, have excellent strength and preservation during transport;
- there is a high reduction in energy consumption, since the motor or motors that perform mixing are used only at the time of unloading;
- the possibility to vary the proportions even during the unloading of the mix, and a reduced consumption of water for washing the plant.

Finally, it is evident that the invention as described and illustrated is in practice susceptible of structurally and functionally equivalent modifications and variations without abandoning the scope of the protection of said invention.

What is claimed is:

1. An apparatus for producing and distributing cement mix, by mixing proportioned amounts of inert materials, cement and water and simultaneously distributing the prepared mix, the apparatus comprising:

a supporting framework;

at least one hopper-like prism-shaped container for the inert materials supported on said framework;

an adjustable discharge opening for the inert materials provided at said at least one inert material container;

at least one hopper-shaped container for the cement being supported on said framework in a raised position with respect to said at least one inert material container;

an adjustable discharge opening for the cement provided at said at least one cement container, said inert material and cement discharge openings being aligned along an inclined plane;

an endless conveyor belt being interposed between the framework and said inert material and cement discharge openings, and extending along said inclined plane from said inert material discharge opening to and past said cement discharge opening;

a screw mixer being arranged along a horizontal axis thereof and beneath said conveyor belt, at an end of said conveyor belt, said screw mixer being actuatable for preparing said mix;

a water reservoir for providing mixing water to said mixer;

said conveyor belt conveying to said screw mixer proportioned amounts of inert materials and cement discharged from said inert material and cement discharge openings, for preparing said mix and simultaneously delivering the prepared mix, the apparatus further comprising a cutoff lamina, said at least one inert material container having an inclined bottom wall and a transverse wall, said conveyor belt being, along part of its length, arranged internally and in contact with the inclined bottom wall of said at least one inert material container, the discharge opening of said inert material container being formed by said cutoff lamina which is arranged parallel to and above the conveyor belt and at a given distance from the transverse wall of the inert material container, so as to leave a first end portion of the conveyor belt directly in contact with the inert materials, said cutoff lamina being movably mounted with an elevation thereof being adjustable with respect to said underlying conveyor belt for allowing feeds of inert materials to be proportioned according to requirements.

2. The apparatus according to claim 1, comprising a double-action actuation piston being coupled to a bottom part of said at least one cement container and a second adjustably movable cutoff lamina, a second end portion of said conveyor belt passing beyond said at least one inert material container and being arranged below said cement discharge opening, adjustment of said cement discharge opening being achieved through movement of said second cutoff lamina externally and parallel to said bottom portion of said at least one cement container, said second cutoff lamina being actuated by said actuation piston.

3. The apparatus according to claim 1, comprising an inclined transverse wall dividing said at least one inert material and cement containers and an additional cutoff lamina for the inert materials provided at said inclined transverse wall above said conveyor belt, said additional cut-off lamina being movable in contact with said inclined transverse wall and having adjustable elevation with respect to said conveyor belt, by any of a manual, mechanical and electrical actuation.

4. The apparatus according to claim 3, comprising vibrating devices which are applied to at least one of said walls of said at least one inert material and cement containers and for facilitating descent of the inert materials and cement onto the conveyor belt, and electronic continuous weighing cells for the inert materials and for the cement, said weighing cells being connected to said conveyor belt.

5. The apparatus according to claim 4, comprising, for said cement discharge opening, a volumetric dosage device of the star type with adjustable rotation rate.

6. The apparatus according to claim 1, wherein dividing walls are provided inside said inert material and cement containers, said dividing walls allowing differentiated proportioning of the inert materials and cement.

7. The apparatus according to claim 1, wherein said conveyor belt and said screw mixer are actuatable through any of an independent motor means and a single drive.

8. The apparatus according to claim 1, wherein said apparatus is mountable on a truck, and the actuation of said conveyor belt and of said screw mixer is performable by drawing power from any of a tilting device of the truck and from a gearbox of said truck.

* * * * *